US007392818B2

(12) United States Patent
Hsu et al.

(10) Patent No.: US 7,392,818 B2
(45) Date of Patent: Jul. 1, 2008

(54) SLURRY DISPENSING SYSTEM

(75) Inventors: Ming-Tzung Hsu, Hsinchu County (TW); Paul Tan, Hsinchu (TW); Chiang-Jeh Chen, Hsinchu (TW); Cho-Ching Chen, Hsinchu County (TW); Hui-Ming Chu, Hsinchu (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 41 days.

(21) Appl. No.: 11/557,118

(22) Filed: Nov. 7, 2006

(65) Prior Publication Data

US 2008/0017249 A1 Jan. 24, 2008

Related U.S. Application Data

(60) Provisional application No. 60/807,959, filed on Jul. 21, 2006.

(51) Int. Cl.
*F16K 51/00* (2006.01)
*F16K 11/00* (2006.01)

(52) U.S. Cl. ..... 137/1; 137/240; 137/563; 137/565.01

(58) Field of Classification Search ..... 137/240, 137/563, 565.01, 1; 239/124, 127
See application file for complete search history.

(56) References Cited

U.S. PATENT DOCUMENTS 3,061,198 A * 10/1962 Kerr et al. ..... 137/624.13
4,513,894 A * 4/1985 Doyle et al. ..... 239/124
5,556,033 A * 9/1996 Nachtman ..... 239/124

* cited by examiner

*Primary Examiner*—Kevin L Lee
(74) *Attorney, Agent, or Firm*—Thomas, Kayden, Horstemeyer & Risley

(57) ABSTRACT

A slurry dispensing system comprises a first supply station, a second supply station, a first loop, a second loop, a first valve and a second valve. The first loop is selectively connected to the first supply station and the second supply station. The second loop is also selectively connected to the first supply station and the second supply station. The first valve connects the first loop to points of use. The second valve connects the second loop to the points of use. When slurry is supplied to the first loop from the first slurry station, slurry is supplied to the second loop from the second slurry station. When the first valve is opened and the second valve is closed, slurry is supplied to the points of use from the first loop.

12 Claims, 7 Drawing Sheets

SLURRY DISPENSING SYSTEM

BACKGROUND OF THE INVENTION

1. Field of the Invention

The invention relates to slurry supply, and in particular to a slurry dispensing system with dual loop for non-stop supply during flushing.

2. Description of the Related Art

FIG. 1 depicts a conventional slurry supply system comprising a supply unit 100, a slurry loop A and a slurry loop B. The supply unit 100 comprises a station A and a station B. The station A and station B have the same structure. The station A comprises a tank 10, a pump 20, and valves 30, 40 and 50. The station A and station B are serially connected by loop A. The loop B is connected to loop A via valves 140 and 240. As slurry is expended during chemical flushing, slurry supply is switched to the station B after a predetermined operating period of the station A, whereby the station A is replenished with new slurry. When slurry is supplied from the station A, the valves 30, 40 in the station A and the valve 50' in the station B are opened. Slurry runs in loop A via pressure control units 200 to provide slurry for a plurality of points of use 500 (FIG. 1 shows only one) by opening the valves 120 and 220. When loop A is to be maintained, such as cleaning or washing, the valves 120 and 220 are closed and the valve 240 is opened, whereby slurry runs in loop B. The valve 140 is not opened until the slurry in the loop B reaches a stable state, normally taking several hours to one day to achieve a stable state, during which points of use 500 are idle while awaiting slurry supply, reducing manufacturing efficiency.

BRIEF SUMMARY OF INVENTION

An embodiment of a slurry dispensing system comprises a first supply station, a second supply station, a first loop, a second loop, a first valve and a second valve. The first loop is selectively connected to the first supply station and the second supply station. The second loop is also selectively connected to the first supply station and the second supply station. The first valve connects the first loop to the points of use. The second valve connects the second loop to the points of use. When slurry is supplied to the first loop from the first slurry station, slurry is supplied to the second loop from the second slurry station. When the first valve is opened and the second valve is closed, slurry is supplied to the points of use from the first loop.

The first supply station comprises a first tank storing slurry, a first pump connected to the first tank, and a first valve module. Slurry is driven by the first pump from the first tank via the first valve module which controls slurry into either the first loop or the second loop.

The second supply station comprises a second tank storing slurry, a second pump connected to the second tank, and a second valve module, wherein slurry is driven by the second pump from the second tank via the second valve module which controls slurry into either the first loop or the second loop.

The dispensing system further comprises a cleaning tank connected to the first loop or the second loop. When slurry in the first loop or the second loop is evacuated, cleaning solution is supplied into the first loop or the second loop.

A method of changing slurry supply without interruption comprises providing a dispensing system comprising a first loop, a second loop, a first valve connecting the first loop to the points of use and providing slurry from the first loop to the points of use when open, and a second valve connecting the second loop to the points of use and providing slurry from the second loop to the points of use when open, supplying slurry into the second loop with the second valve closed when the first loop, in which slurry runs with the first valve opened, is to be maintained, and opening the second valve and closing the first valve when slurry in the second loop reaches a stable state.

The method further comprises providing a first supply station selectively connecting to the first loop or the second loop for slurry supply, providing a second supply station selectively connecting to the first loop or the second loop for slurry supply, supplying slurry into the second loop from the second supply station when the first loop, in which slurry runs from the first supply station, is to be maintained, and supplying slurry into the second loop from the first supply station when the first loop, in which slurry runs from the second supply station, is to be maintained.

The method further comprises providing a cleaning tank filled with cleaning fluid connected to the first loop or the second loop, supplying cleaning fluid to the first loop when slurry in the first loop is evacuated, and supplying cleaning fluid to the second loop when slurry in the second loop is evacuated.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 1:
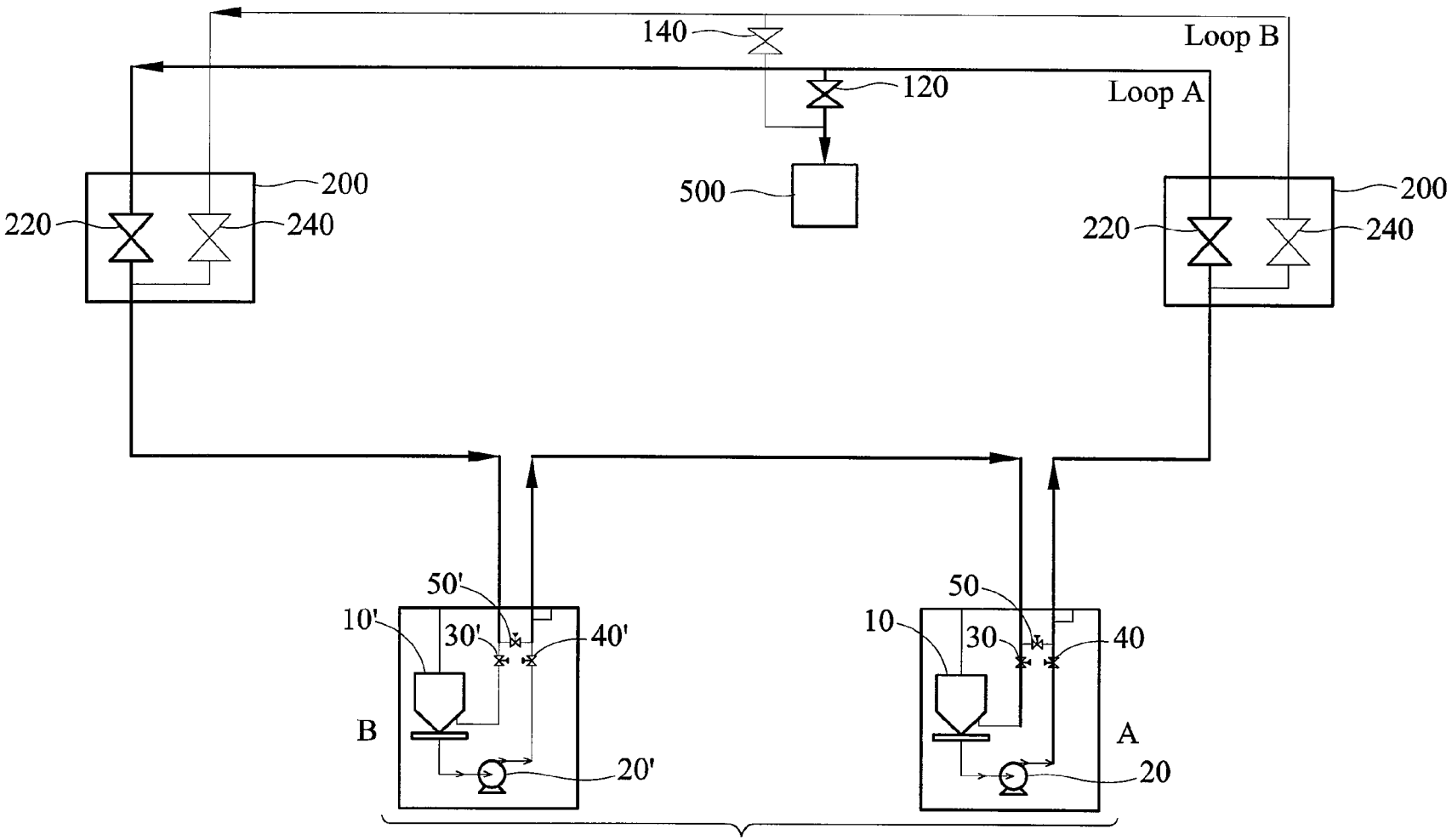
FIG. 1 ( RELATED ART )
FIG. 1 is a conventional slurry supply system.
Figure 2:
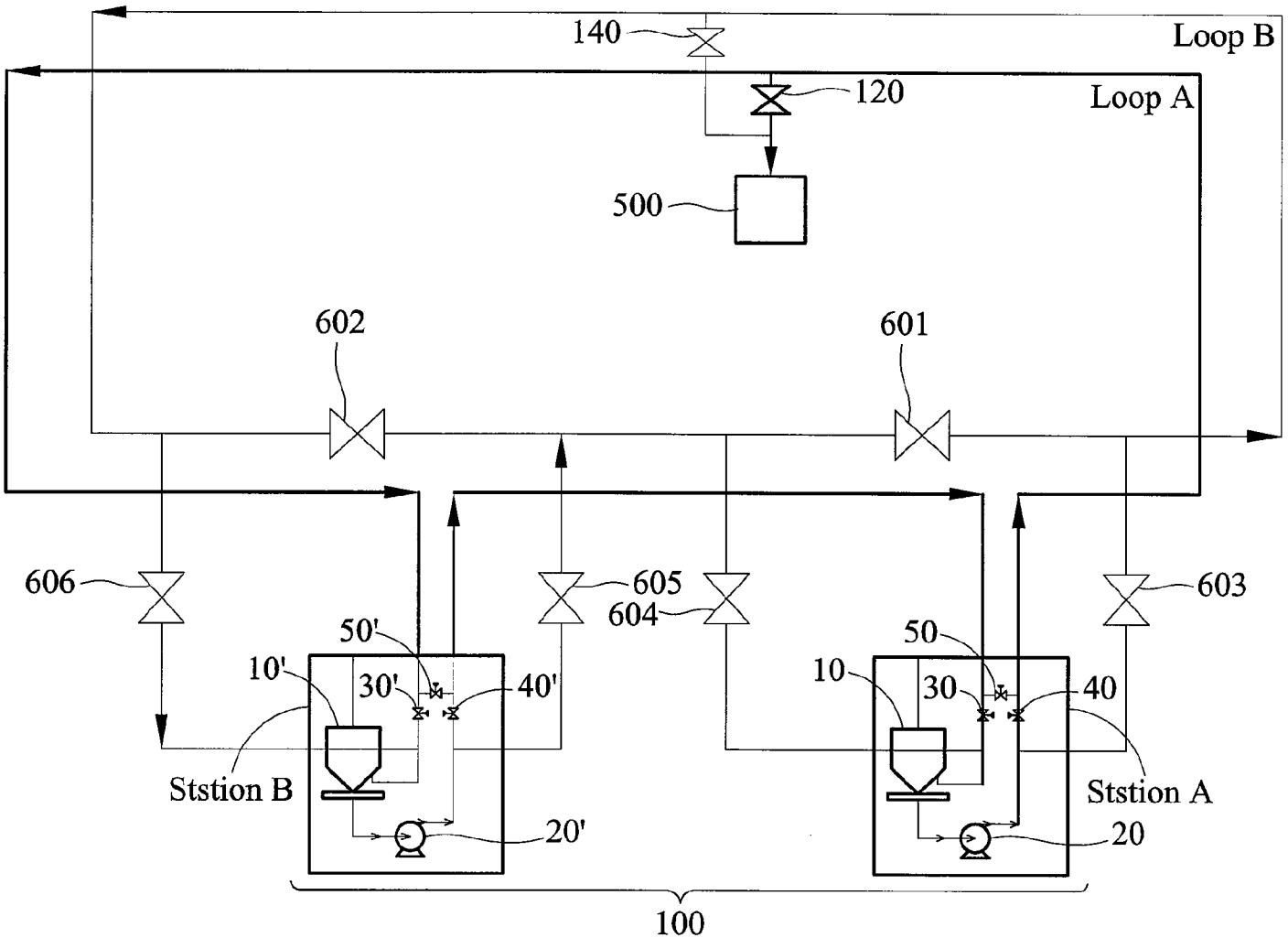
FIGS. 2, 3 and 4 are a schematic views of a slurry supply system of the invention.

FIG. 2 depicts a slurry supply system of the invention. The slurry supply system comprises a supply unit 100, a loop A and a loop B. The supply unit 100 comprises a station A and a station B. In this embodiment, the station A and station B have the same structure. The station A comprises a tank 10, a pump 20, and a first valve module having valves 30, 40, 50, 601, 603 and 604 (first valve, second valve, third valve, sixth valve, fifth valve and fourth valve). The station B comprises a tank 10', a pump 20', and a second valve module having valves 30', 40', 50', 602, 605 and 606 (seventh valve, eighth valve, ninth valve, twelfth valve, eleventh valve and tenth valve). The loop A is connected to both the station A and station B, and the loop B is also connected to both station A and station B. The loop A is connected to the station A via the valves 30, 40, 50, and to the station B via the valves 30', 40' and 50'. The loop B is connected to the station A via the valves 603 and 604, and to the station B via the valves 605 and 606. When the valves 30 and 40 are opened, and the valve 50 is closed, slurry is driven by the pump 20 from the tank 10 to the loop A. When the valves 30 and 40 are closed, and the valve 50 is opened, slurry in runs through station A. When valve 603 and 604 are opened and the valve 601 is closed, slurry is driven by the pump 20 from the tank 10 to the loop B. When valve 603 and 604 are closed and the valve 601 is opened, slurry runs through station A. When the valves 30' and 40' are opened and the valve 50' is closed, slurry is driven by the pump 20' from the tank 10' to loop A. When the valves 30' and 40' are closed and the valve 50' is opened, slurry runs through station B. When the valves 605 and 606 are opened and the valves 602 are closed, slurry is driven by the pump 20' from the tank 10' to loop B. When the valves 605 and 606 are closed and the valves 602 are opened, slurry runs through station B. Slurry selectively runs in loop A or loop B. Loop A is connected to the points of use via a first valve device 120, and the loop B is connected to the points of use via a second valve device 140.

Figure 3:
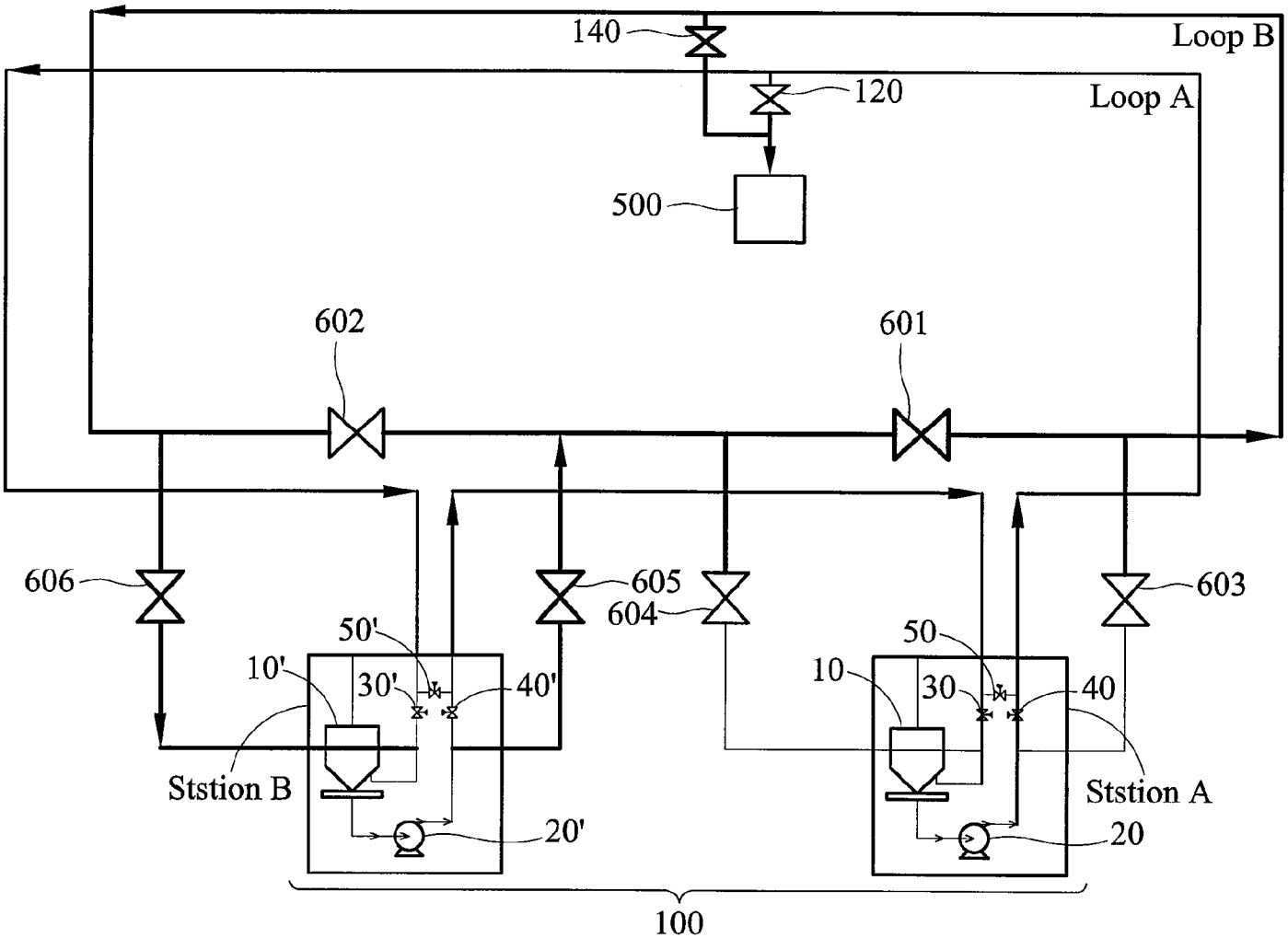
Figure 4:
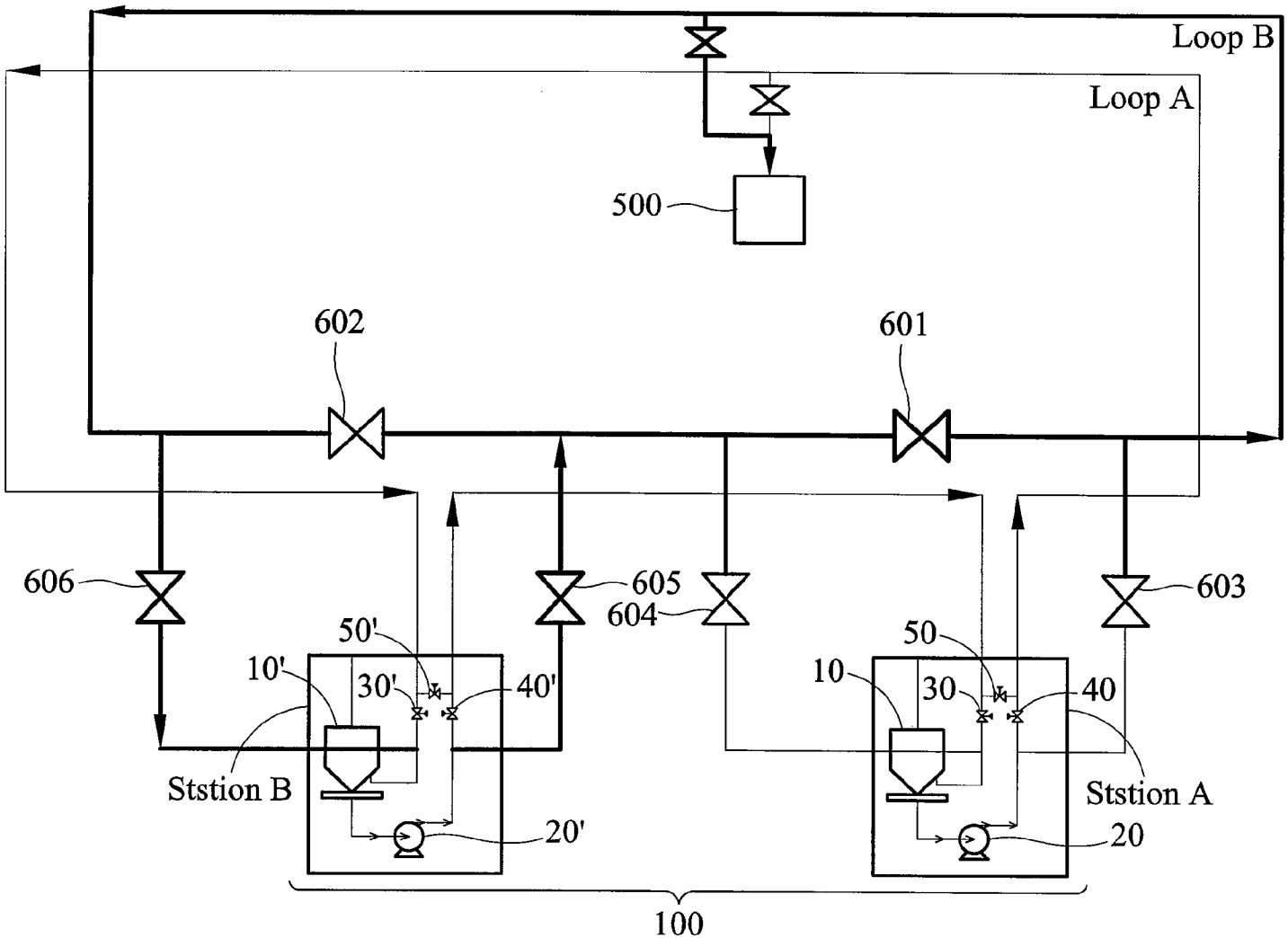
Figure 5:
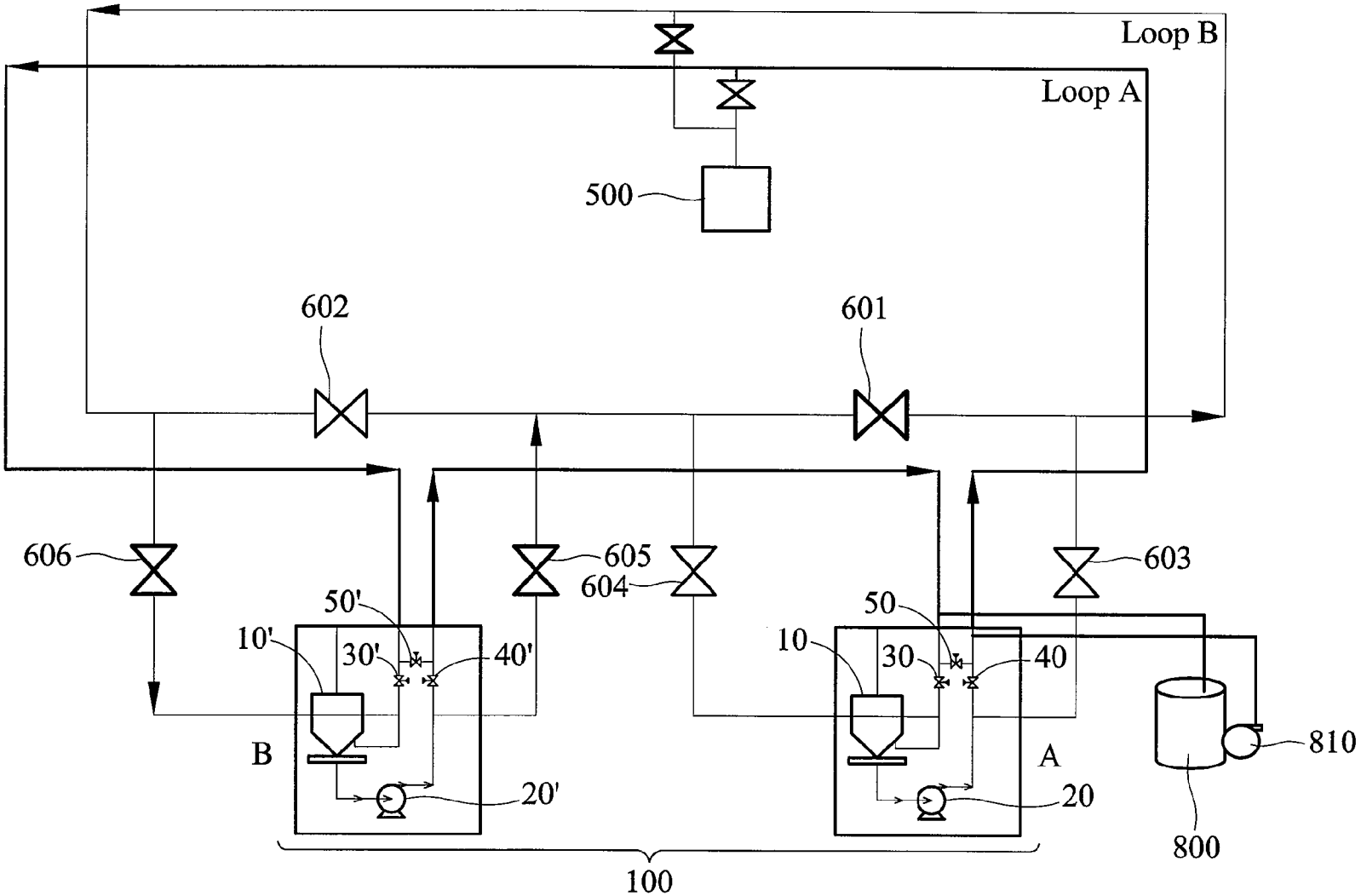
FIG. 5 depicts loop A of the slurry supply system of the invention undergoing cleaning by a tank with KOH solution.

In FIG. 2, slurry is supplied from the station A to the points of use 500 via the loop A with the valves 30, 40 and 50' open. The loop A is indicated by a thick line for slurry supply and the loop B is indicated by a thin line for no slurry supply. When the loop A is to be maintained, the station B supplies slurry to the loop B with the valves 601, 605 and 606 open and the valves 602, 603 and 604 closed. At this time, slurry in the loop A still runs, as shown in FIG. 3, the loop A and the loop B are both indicated by thick lines. When slurry in the loop B reaches a stable state, the first valve device 120 is gradually closed and the second valve device 140 is gradually opened simultaneously. When the first valve device 120 is completely closed and the second valve device 140 is completely open, slurry is supplied from the station B to the points of use 500 via the loop B, as shown in FIG. 4. The loop B is indicated by a thick line and the loop A is indicated by a thin line. The station A shuts down. A tank 800 filled with KOH solution is connected to loop A as shown in FIG. 5. Pump 810 circulates KOH solution in loop A for cleaning. The tank 800 can also be connected to loop B for cleaning. The KOH solution in tank 800 can also be used to clean station A, station B or points of use 500 via loop A or loop B.

In conventional use, when slurry is expended, slurry supply can be switched from station A to station B. In the invention, as loop A and loop B are independently connected to station A and station B, slurry can be supplied from station A to station B or from station B to station A when either loop A or loop B is used. For example, when loop A is used and slurry is supplied from station A and slurry is expended, slurry supply can be switched from station A to station B. Station A is replenished. After a certain period when loop A is to be maintained and the station A is replenished, slurry can be supplied from station A to loop B with the valves 602, 603 and 604 open and the valves 601, 605 and 606 closed. When slurry in loop B reaches a stable state, the second valve device 140 is gradually opened and the first valve device 120 is gradually closed, whereby the slurry supply is switched from loop A to loop B.

Figure 6:
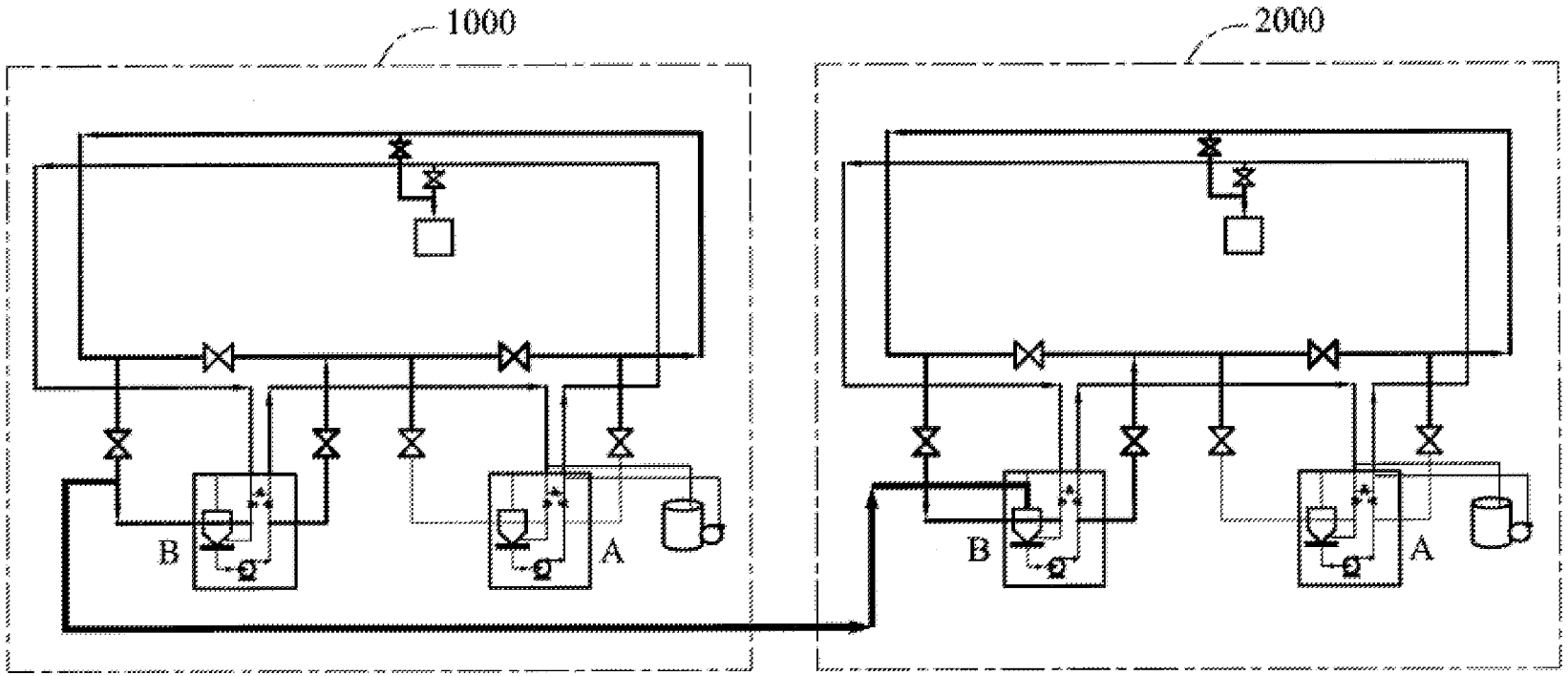
FIG. 6 depicts a combination of two slurry supply systems of the invention.

FIG. 6 depicts combination of two slurry supply systems of the invention. Station B in slurry supply system 1000 is connected to Station B in slurry supply system 2000. Slurry can be provided from slurry supply system 1000 to slurry supply system 2000 to replenish station B in supply system 2000.

Figure 7:
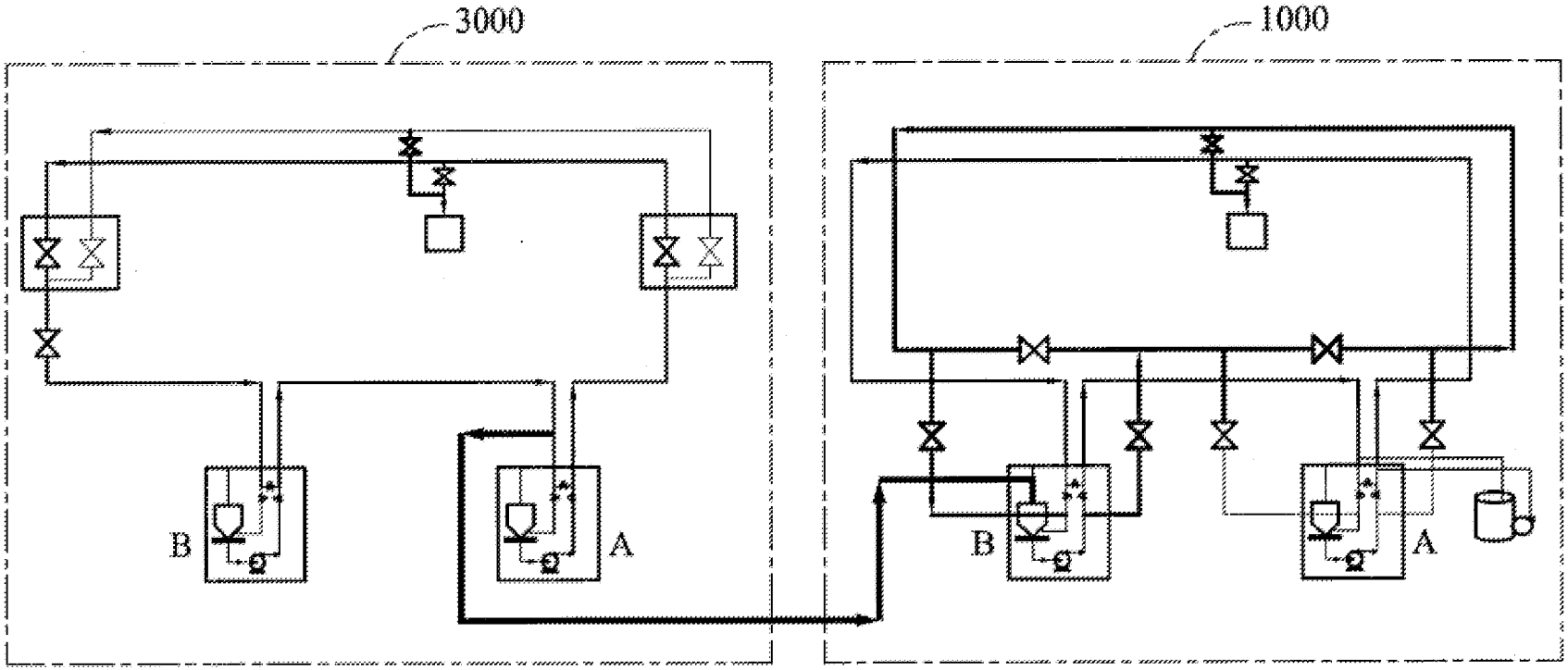
FIG. 7 depicts combination of a conventional slurry supply system and a slurry system of the invention.

FIG. 7 depicts combination of a conventional slurry supply system and a slurry system of the invention. Station B in the slurry supply system 1000 of the invention is connected to the station A of the conventional slurry system 3000. Slurry can be provided from the conventional slurry supply system 3000 to slurry system 1000.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A slurry dispensing system, comprising a first supply station;

a second supply station;

a first loop selectively connected to the first supply station and the second supply station;

a second loop selectively connected to the first supply station and the second supply station;

a first valve device connecting the first loop to points of use;

a second valve device connecting the second loop to the points of use, wherein when slurry is supplied to the first loop from the first supply station, slurry is supplied to the second loop from the second supply station, and when slurry is supplied to the second loop from the first supply station, slurry is supplied to the first loop from the second supply station, and when the first valve is opened, slurry is supplied to the points of use from the first loop, and when the second valve is opened, slurry is supplied to the points of use from the second loop.

2. The dispensing system as claimed in claim 1, wherein the first supply station comprises:

a first tank storing slurry;

a first pump connected to the first tank; and a first valve module, wherein slurry is driven by the first pump from the first tank via the first valve module which controls slurry into either the first loop or the second loop.

3. The dispensing system as claimed in claim 2, wherein the first valve module comprises a first valve connecting the first tank and the first loop, a second valve connecting the first pump and the first loop, a third valve connecting the first and second valves, a fourth valve connecting the first tank to the second loop, a fifth valve connecting the first pump to the second loop and a sixth valve connecting the fourth valve and the fifth valve, and when the first valve and the second valve are opened and the third valve is closed, slurry is driven by the first pump from the first tank to the first loop, and when the first and second valves are closed, and the third valve is opened, slurry passes through the first supply station, and when the fourth valve and the fifth valve are opened and the sixth valve is closed, slurry is driven by the first pump from the first tank to the second loop, and when the fourth valve and the fifth valve are closed and the sixth valve is opened, slurry passes through the first supply station.

4. The dispensing system as claimed in claim 2, wherein the second supply station comprises:

a second tank storing slurry;

a second pump connected to the second tank; and a second valve module, wherein slurry is driven by the second pump from the second tank via the second valve module which controls slurry into either the first loop or the second loop.

5. The dispensing system as claimed in claim 4, wherein the second valve module comprises a seventh valve connecting the second tank and the first loop, a eighth valve connecting the second pump and the first loop, a ninth valve connecting the seventh and eighth valves, a tenth valve connecting the second tank to the second loop, a eleventh valve connecting the second pump to the second loop and a twelfth valve connecting the tenth valve and the eleventh valve, and when the seventh valve and the eighth valve are opened and the ninth valve is closed, slurry is driven by the second pump from the second tank to the first loop, and when the seventh and eighth valves are closed, and the ninth valve is opened, slurry passes through the second supply station, and when the tenth and eleventh valves are opened and the twelfth valve is closed, slurry is driven by the second pump from the second tank to the second loop, and when the tenth and eleventh valves are closed and the twelfth valve is opened, slurry passes through the second supply station.

6. The dispensing system as claimed in claim 1 further comprising a cleaning tank filled with cleaning fluid and connected to the first loop or the second loop, wherein when slurry in the first loop or the second loop is evacuated, the cleaning fluid is supplied into the first loop or the second loop.

7. A slurry dispensing system, comprising a first supply station;

a second supply station;

a first loop selectively connected to the first supply station and the second supply station;

a second loop selectively connected to the first supply station and the second supply station; and a valve module comprising:

a first valve device connecting the first loop to points of use; and a second valve device connecting the second loop to the points of use, wherein the first valve device and the second valve device are selectively opened and closed at the same time.

8. A slurry dispensing system combination comprising:

a first slurry dispensing system as claimed in claim 1;

a second slurry dispensing system as claimed in claim 1, wherein the slurry is supplied to the first supply station of the first slurry dispensing system from the first loop of the second slurry dispensing system.

9. A slurry dispensing system combination comprising:

a first slurry dispensing system as claimed in claim 1;

a second slurry dispensing system comprising:

a first supply station;

a second supply station;

a first loop connected to the first supply station and the second supply station; and a second loop connected to the first loop, wherein the slurry is supplied to the first station of the first slurry dispensing system from the first loop of the second slurry dispensing system.

10. A method of changing slurry supply, comprising:

providing a dispensing system comprising a first loop, a second loop, a first valve device connecting the first loop to points of use and providing slurry from the first loop to the points of use when open, and a second valve device connecting the second loop to the points of use and providing slurry from the second loop to the points of use when open;

supplying slurry into the second loop with the second valve device closed when the first loop, in which slurry runs with the first valve device open, is to be maintained; and opening the second valve device and closing the first valve device when slurry in the second loop reaches a stable state.

11. The method as claimed in claim 10 further comprising:

providing a first supply station selectively connecting to the first loop or the second loop for slurry supply;

providing a second supply station selectively connecting to the first loop or the second loop for slurry supply;

supplying slurry into the second loop from the second supply station when the first loop, in which slurry runs from the first supply station, is to be maintained; and supplying slurry into the second loop from the first supply station when the first loop, in which slurry runs from the second supply station, is to be maintained.

12. The method as claimed in claim 10 further comprising:

providing a cleaning tank filled with cleaning fluid connected to the first loop or the second loop;

supplying cleaning fluid to the first loop when slurry in the first loop is evacuated; and supplying cleaning fluid to the second loop when slurry in the second loop is evacuated.

* * * * *